US005551852A

United States Patent [19]

Saito et al.

[11] Patent Number: 5,551,852

[45] Date of Patent: Sep. 3, 1996

[54] SCROLL TYPE COMPRESSOR HAVING A SEAL BEARING UNIT

[75] Inventors: Susumu Saito; Nobukazu Takagi; Kiyohiro Harada; Yukio Kazahaya; Seiji Kuchiki; Masakuni Ishikawa; Nobuyuki Nakajima, all of Konan, Japan

[73] Assignee: Zexel Corporation, Tokyo, Japan

[21] Appl. No.: 505,641

[22] Filed: Jul. 21, 1995

[30] Foreign Application Priority Data

Jul. 29, 1994 [JP] Japan ..... 6-197753

[51] Int. Cl.[6] ..... F01C 21/04; F01C 1/04

[52] U.S. Cl. ..... 418/98; 418/55.4; 418/55.6; 418/94

[58] Field of Search ..... 418/55.1, 55.4, 418/94, 98, 55.6; 384/123, 124

[56] References Cited

U.S. PATENT DOCUMENTS 5,192,136 3/1993 Thompson et al. ..... 384/123

5,263,822 11/1993 Fujio ..... 418/55.4

5,413,469 5/1995 Nakajima et al. ..... 418/94

FOREIGN PATENT DOCUMENTS 499419 1/1976 U.S.S.R. ..... 384/121

*Primary Examiner*—Charles G. Freay

*Attorney, Agent, or Firm*—Wenderoth, Lind & Ponack

[57] ABSTRACT

A scroll type compressor including a drive shaft which is provided with a spiral groove formed in an external circumferential surface of the drive shaft. The spiral groove communicates diagonally between the oil space and the upper portion of the main bearing to ensure sufficient lubrication and sealing in the area where the drive shaft slide in contact with the main bearing. A seal bearing portion is positioned between the oil space and the low pressure space to isolate the oil space from the low pressure orbiting space, achieving an improvement in lubrication. The seal bearing portion is constituted with a seal washer, a seal bearing and a seal member, and, furthermore, with seal reinforcing material, to especially improve the seal between the oil space and the oscillation space.

18 Claims, 9 Drawing Sheets

SCROLL TYPE COMPRESSOR HAVING A SEAL BEARING UNIT

BACKGROUND OF THE INVENTION

1. Field of the Invention

The present invention relates to a scroll type compressor which is a coolant compressor used in freezers or air conditioners and is provided with a coil-like fixed scroll and an oscillating scroll that interlocks with the fixed scroll to form a scroll chamber, in which the volumetric capacity of the scroll chamber is varied with the orbiting motion of the orbiting scroll (a swinging movement with no self-rotation) to compress the coolant.

2. Description of the Related Art

A scroll type compressor of the prior art is provided with a drive shaft that is rotated by a driving means such as an electric motor, an oscillating scroll member that is mounted decentered, i.e. eccentrically on the drive shaft, and a fixed scroll member that interlocks with the oscillating scroll member to form a compression space (scroll chamber). The volumetric capacity of the scroll chamber is varied by moving the orbiting scroll member relative to the fixed scroll member to take in, compress and discharge the coolant. In this type of structure, the lubrication and sealing of the various sliding contact surfaces of the scroll type compressor are crucial factors.

Accordingly, the scroll type compressor disclosed in Japanese Patent Unexamined Publication No. H3-149391 includes a rotary displacement type oil pump so that a sufficient quantity of lubricating oil is reliably supplied to the bearings regardless of the flow rate of the lubricating oil supplied to the compression work space. With this, a large quantity of lubricating oil is assured even when high loads are applied to the sliding contact surface of the oscillating scroll member and the drive shaft, the main bearing in the area where the drive shaft slides against the block that secures the fixed scroll member, the thrust bearing provided in the area where the orbiting scroll member slides against the block, and the like.

However, with the scroll type compressor in the example quoted above, a problem arises if a material other than ferrite is used for the fixed scroll member and the orbiting scroll member. Materials such as an aluminum alloy are used in order to reduce weight and cost of the compressor. Due to the high back pressure on the orbiting scroll member, it is pressed towards the fixed scroll member, resulting in seizure in the area where the orbiting scroll member slides in contact with the fixed scroll member.

SUMMARY OF THE INVENTION

The object of the present invention is to provide a scroll type compressor in which sufficient lubrication and sealing of the sliding contact areas are assured with a simple structure.

In order to achieve this object, the present invention is a scroll type compressor that comprises a drive unit that is provided in a high pressure space within a sealed case, an orbiting shaft that is formed as a decentered extension of the drive shaft of the drive unit, a bearing, into which the orbiting shaft is inserted, an orbiting scroll member that orbits with the rotation of the drive shaft, a block that is secured within the sealed case and is provided with a through hole that accommodates a main bearing, which, in turn, holds the drive shaft in such a manner that it can rotate freely, a fixed scroll member that encloses the orbiting scroll member between itself and the block in such a manner that the orbiting scroll can orbit freely, an oil reservoir for storing lubricating oil formed in the upper portion of the block and within the high pressure space, an oil space formed below the lower side surface of the main bearing and communicating with the oil reservoir, at least one spiral groove formed in the external circumferential surface of the drive shaft with one end opening into the oil space and the other end rising toward the upper end of the main bearing at a specific angle, an oil induction hole that communicates between the oil space and a bearing space which is formed with the orbiting shaft inserted into the oscillating bearing and a seal bearing portion provided between the end of the drive shaft and the block formed with the oscillating scroll member and the block in order to cut off a space, in which the bearing orbits, from the oil space. The seal bearing portion comprises a seal bearing for cutting off the space in which the bearing orbits from the oil space, a circular seal washer that is in contact with one of the side surfaces of the seal bearing and whose surface is polished to a specific surface roughness and a seal member which is externally fitted from the side opposite the side of the seal bearing that is in contact with the seal washer.

According to the present invention, since there is at least one spiral groove formed in the external circumferential surface of the drive shaft in the area where it is in sliding contact with the main bearing, a seal bearing for cutting off the oil space from the orbiting space is provided between the drive shaft and the block and an oil induction hole for communicating between the oil space and the bearing space which is formed and with the oscillating scroll member and the oscillating bearing is formed, a first oil path for lubricating the main bearing via the spiral groove, which functions as a pump with the rotation of the drive shaft, and a second oil path, which, due to the pressure differential between the oil space and the intake chamber, passes lubricating oil through the oil induction hole, the bearing space, the oscillating bearing, the orbiting space, the thrust bearing, the Oldham's ring, the scroll chamber and the orbiting bearing, are formed. As a result, lubricating oil is supplied to the main bearing and the orbiting bearing separately, achieving efficient lubrication.

In addition, with the seal washer formed to have a specific surface roughness being provided between the seal bearing and the drive shaft, the polishing process required in forming the drive shaft and the seal bearing is simplified and the life of the seal bearing is lengthened. Consequently, the seal between the oil space and the oscillation space is maintained over an extended period of time. Furthermore, by mounting a seal member comprising an inner seal portion for sealing between the seal bearing and the drive shaft, an outer seal portion for sealing between the seal bearing and the block and a side plate, which is provided continuously from one end of the inner seal portion and one end of the outer seal portion, to the seal bearing, the seal between the seal bearing and the drive shaft and the seal between the seal bearing and the block are improved. Moreover, with a seal reinforcing member which is circularly formed provided between the side plate of the seal member and the block, damage to the seal member in the area where the seal member is in contact with the block is prevented.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of the preferred embodiments according to the present invention in reference to the drawings.

Figure 1:
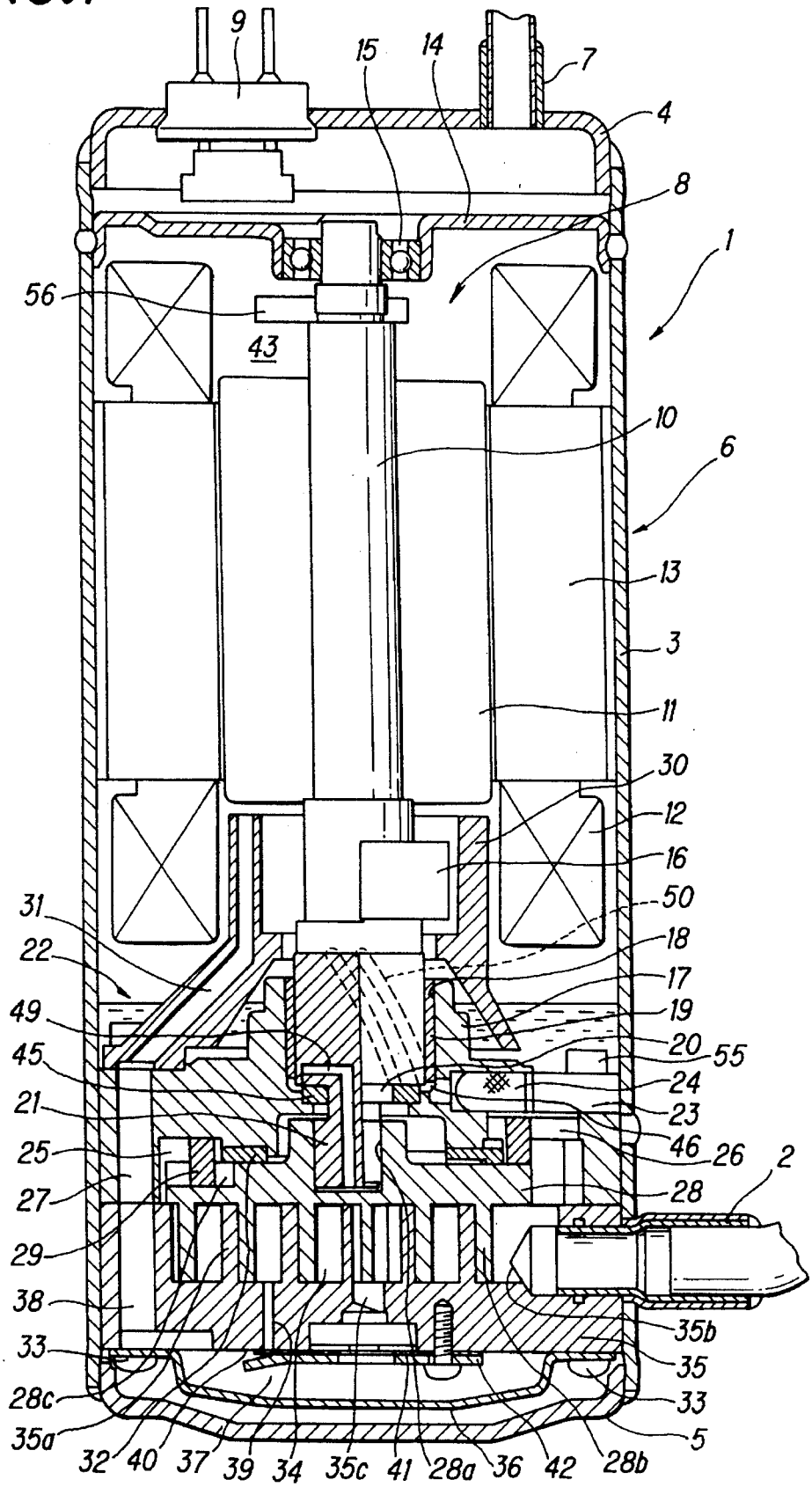
FIG. 1 is a cross section of an embodiment of the scroll type compressor.

In the scroll type compressor 1 shown in FIG. 1, a sealed case 6 is structured with a cylindrical member 3 that is provided with a coolant intake port 2, a cap member 4 that seals the upper end of the cylindrical member 3, and a base member 5 that seals the lower end of the cylindrical member 3. Note that the cap member 4 is provided with a coolant outlet port 7 and a power supply terminal 9 for an electric motor 8.

The electric motor 8 may be, for example, a DC brushless motor provided with a drive shaft 10, a rotor 11, which is secured onto the drive shaft 10 and is surrounded by a permanent magnet and a stator 13, which is secured onto the internal circumferential surface of the cylindrical member 3 and is wrapped by a coil winding 12. The upper portion of the drive shaft 10 is held by a drive shaft holding member 14 via a bearing 15 in such a manner that it can rotate freely. A balance weight 16 secured to the lower portion of the rotor 11 and a sub balance weight 56 is secured to the upper portion of the rotor 11. In addition, the lower portion of the drive shaft 10 is held in a through hole 18 formed in a block 17 to be explained below via a main bearing 19 in such a manner that it can rotate freely. At the lower end of the drive shaft 10, an orbiting shaft 21 projects decentered from the drive shaft 10 via a bearing mounting portion 20.

The block 17 is secured to the internal circumferential surface of the cylindrical member 3 by means such as spot welding and is provided with the through hole 18 which is formed by piercing the center of the block. The block 17 is also provided with an oil hole 23 which opens into an oil reservoir 22, to be explained later, into which a filter 24 is mounted. The block 17 is further provided with an Oldham's ring housing chamber 25 formed on the surface of the block 17 where an orbiting scroll member 28 slides. An Oldham's ring 29, which prevents the orbiting scroll member 28 from rotating is positioned in chamber 26. The block 17 is also provided with an Oldham's ring groove 26 in which the tab portion of the Oldham's ring 29 is inserted in such a manner that it can slide freely. On this sliding surface a thrust bearing 32 is provided, in which a lubricating oil groove with appropriate constriction is formed.

In the upper portion of the block 17, a cover 30 is provided to enclose the range of the rotation of the balance weight 16 that is mounted on the drive shaft 10. In the surrounding area of the cover 30, at the upper portion of the block 17, an oil reservoir 22 is formed. Note that a coolant outlet hole 31, which communicates with a coolant passage 27 formed in the block 17 is in the cover 30.

The orbiting scroll member 28 is provided with an orbiting bearing **28*a* into which the orbiting shaft 21, which projects as a decentered extension of the drive shaft 10 via the bearing mounting portion 20 is inserted in such a manner that it can rotate freely. On the surface opposite the surface on which the orbiting bearing 28*a* is formed, an orbiting scroll 28*b* is provided in the form of a coil. Note that an Oldham's ring groove 28*c* is formed in the surface where the orbiting bearing 28*a*** is formed.

The fixed scroll member 35 is provided on the upper surface with a fixed scroll **35*a*, which interlocks with the orbiting scroll 28*b* to form a scroll chamber 34 and is secured to the block 17 with a bolt 55 while holding the orbiting scroll member 28 in such a manner that it can orbit freely. An intake chamber 35*b* which communicates with the coolant intake port 2 is provided on the side of the fixed scroll member 35 and an outlet hole 35*c* is formed at the center the fixed scroll member 35. The outlet hole 35*c* communicates with an outlet space 37 which is formed by a cover 36 which covers the lower side surface of the fixed scroll member 35. Also, an outlet passage 38 is formed in the fixed scroll member 35. The passage 38 communicates with the outlet space 37 and also with the coolant passage 27 in the block 17. The cover 36 is secured to the fixed scroll member 35 with a bolt 33. In addition, a bypass passage 39 is formed in the fixed scroll member 35 communicates between the center portion of the scroll chamber 34 and the outlet space 37 which is opened and closed with a relief valve 40. In addition, a check valve 41 is provided at the outlet hole 35*c* and the check valve 41 is held within the outlet hole 35*c* with a check valve retainer 42**.

When the electric motor 8 is driven in the scroll type compressor 1 structured as described above, the orbiting scroll member 28, eccentrically mounted to the drive shaft 10 of the electric motor 8, makes an orbiting motion relative to the fixed scroll member 35 and the volumetric capacity of the scroll chamber 34, constituted by the orbiting scroll **28*b* and the fixed scroll 35*a***, changes, thereby performing intake, compression and discharge in sequence.

With this, the coolant that is drawn in through the coolant intake port 2 is then taken in from the intake chamber **35*b* to be compressed in the scroll chamber 34. It then travels from the outlet hole 35*c* through the outlet space 37, the outlet passage 38, the coolant passage 27 and the coolant outlet hole 31 to reach the high pressure space 43. It is then discharged via the coolant outlet port 7** to be sent to the next process.

Figure 2:
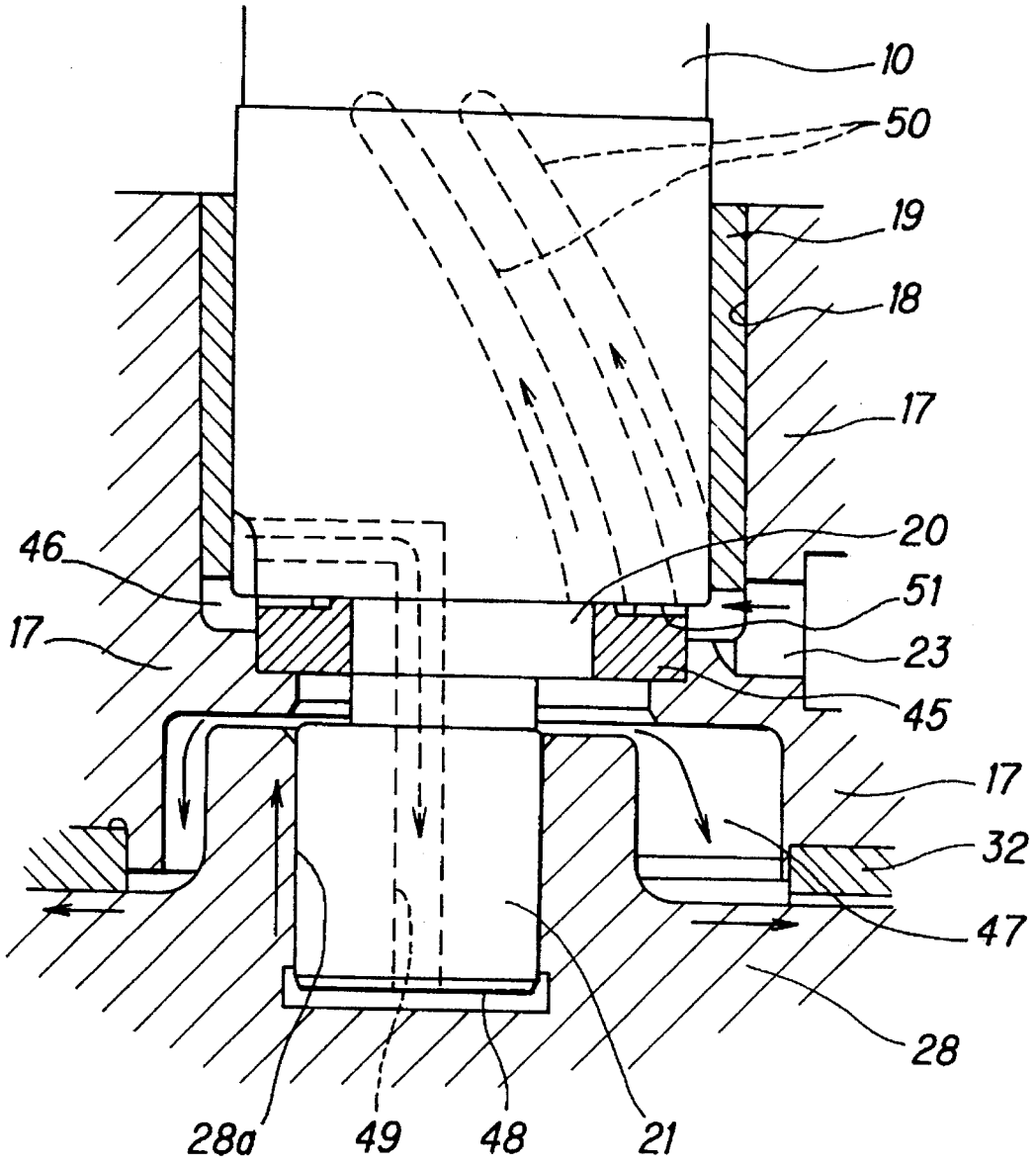
FIG. 2 is an enlarged partial cross section of the scroll type compressor shown in FIG. 1.

In addition, in this scroll type compressor 1, a seal bearing 45 is mounted between the lower end of the drive shaft 10 and the block 17 in the external circumferential area of the bearing mounting portion 20 as shown in FIG. 2, and thus, an oil space 46 is constituted by the block 17, the drive shaft 10, the main bearing 19 and the seal bearing 45. Furthermore, a 47, where the orbiting bearing **28*a* orbits, is formed by the orbiting scroll member 28, the block 17, and the seal bearing 45. To be more specific, with the seal bearing 45, the high pressure oil space 46 is cut off from the orbiting space 47** where the pressure is low or medium.

Figure 5:
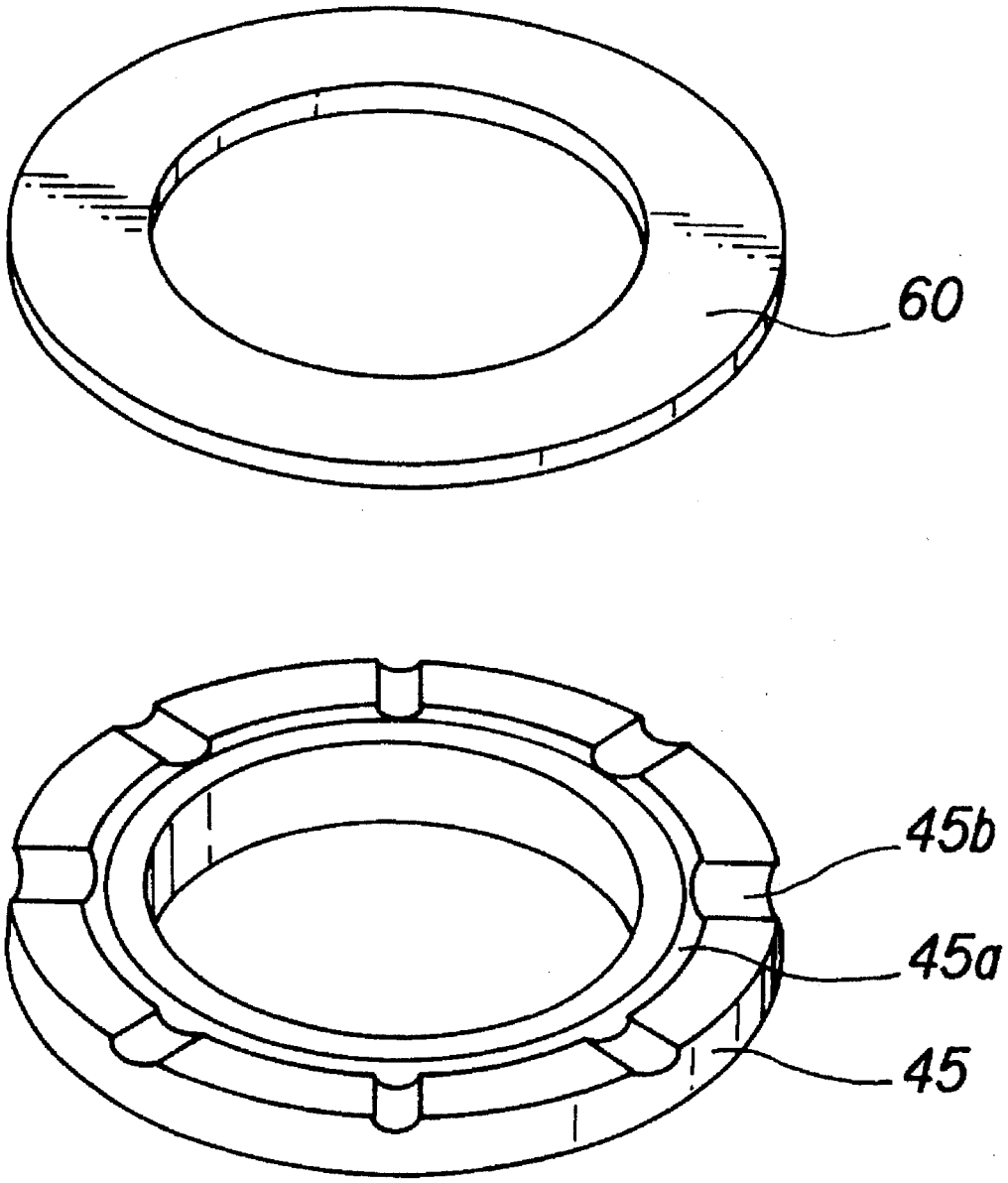
FIG. 5 is a perspective view of the seal bearing and the seal washer of the second embodiment.

The seal bearing 45 is constituted of a bearing material such as sintered metal, copper, Al, FC, FCD, or ferrite on the seal bearing side surface, where it is in contact with the drive shaft 10, a circular groove 45*a* and a plurality of radial grooves 45*b*, which extend radially from the circular groove 45*a*, are formed as shown in FIG. 5. High pressure lubricating oil is supplied to the circular groove 45*a* and the radial grooves 45*b* so that an upward force is applied to the drive shaft 10 to reduce the downward load on the drive shaft 10.

Also, under the orbiting bearing 28*a*, a bearing space 48 is formed by the oscillating shaft 21 inserted into the oscillating bearing 28*a*, and an oil induction hole 49 for communicating between the bearing space 48 and the oil space 46 is formed in the drive shaft 10 and the orbiting shaft 21.

Furthermore, in the drive shaft 10, one or more spiral grooves 50 (two spiral grooves in this embodiment) are formed in the surface where it slides in contact with the main bearing 19. The spiral grooves 50 are formed in the external circumferential surface of the drive shaft 10 where it slides in contact with the main bearing 19 with one end opening into the oil space 46 and inclined at a specific angle along the external circumferential surface of the drive shaft from this opening end at the rear in the direction of the rotation of the drive shaft toward the other end which opens on to the upper end of the main bearing 19.

Figure 3:
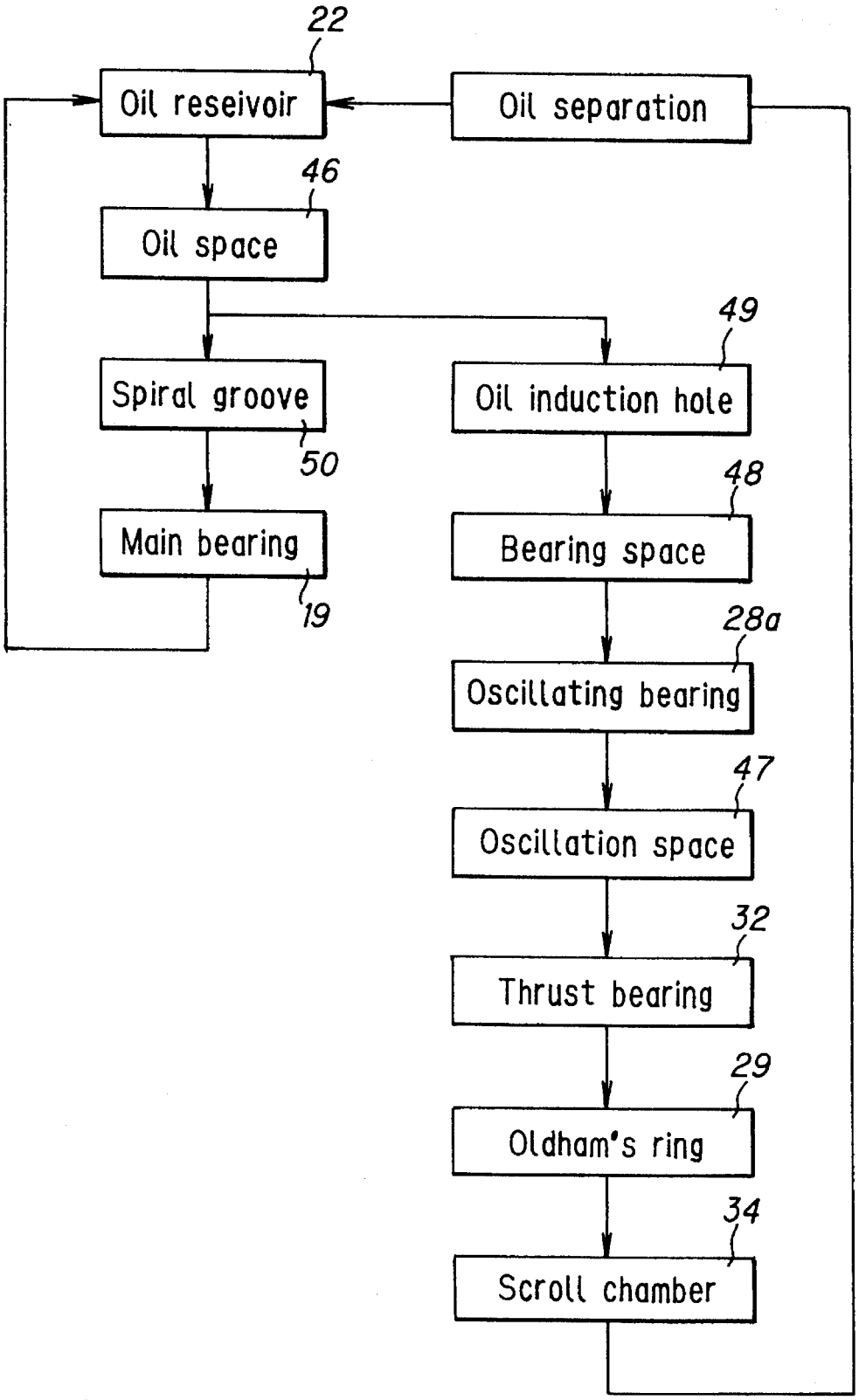
FIG. 3 illustrates the oil paths.

In the structure described above, as shown in FIG. 3, the lubricating oil which travels from the oil reservoir 22 to the oil space 46, takes a first oil path whereby it is drawn in with the rotating movement of the drive shaft 10 from one end of the spiral groove 50, which opens into the oil space 46, then travels upward along the spiral groove 50 and returns to the oil reservoir 22 from the other end, which opens onto the upper end of the main bearing 19. The oil also takes a second oil path whereby, due to the pressure differential between the oil space 46 and the intake chamber 35*b*, the oil travels through the oil induction hole 49, the bearing space 48, along the orbiting bearing 28*a*, the orbiting space 47, the thrust bearing 32, the Oldham's ring 29, the intake chamber 35*b*, the scroll chamber 34 and the outlet hole 35c and then to the high pressure chamber 43 via the passages 38, 27 and 31, where it is separated from the high pressure coolant due to the stirring motion of the rotor 11, to return to the oil reservoir 22. Through the first oil path, the main bearing 19 is lubricated and through the second oil path, the orbiting bearing 28*a* and the thrust bearing 32 are lubricated and also the scroll chamber 34 is lubricated and sealed. A clearance, shown in FIGS. 1–2, between the thrust bearing 32 and an upper surface of the orbiting scroll member form a constriction. Note that if the constriction of the thrust bearing 32 is large, the pressure in the oscillation space 47 will be half way between the pressure in the oil space 46 and the pressure in the intake chamber 35*b* and if the constriction in the thrust bearing 32 is small, the pressure in the oscillation space 47 will be approximately equal to that in the intake chamber 35*b*.

This means that the main bearing 19 is lubricated separately from the orbiting bearing 28*a* and the thrust bearing 32. Also, the hot lubricating oil, heated by lubricating the main bearing 19, is not used to lubricate the oscillating bearing 28*a* and the thrust bearing 32, achieving an improvement in the durability of the lubricating oil and, at the same time, ensuring sufficient lubrication of the oscillating bearing 28*a* and the thrust bearing 32.

Figure 4:
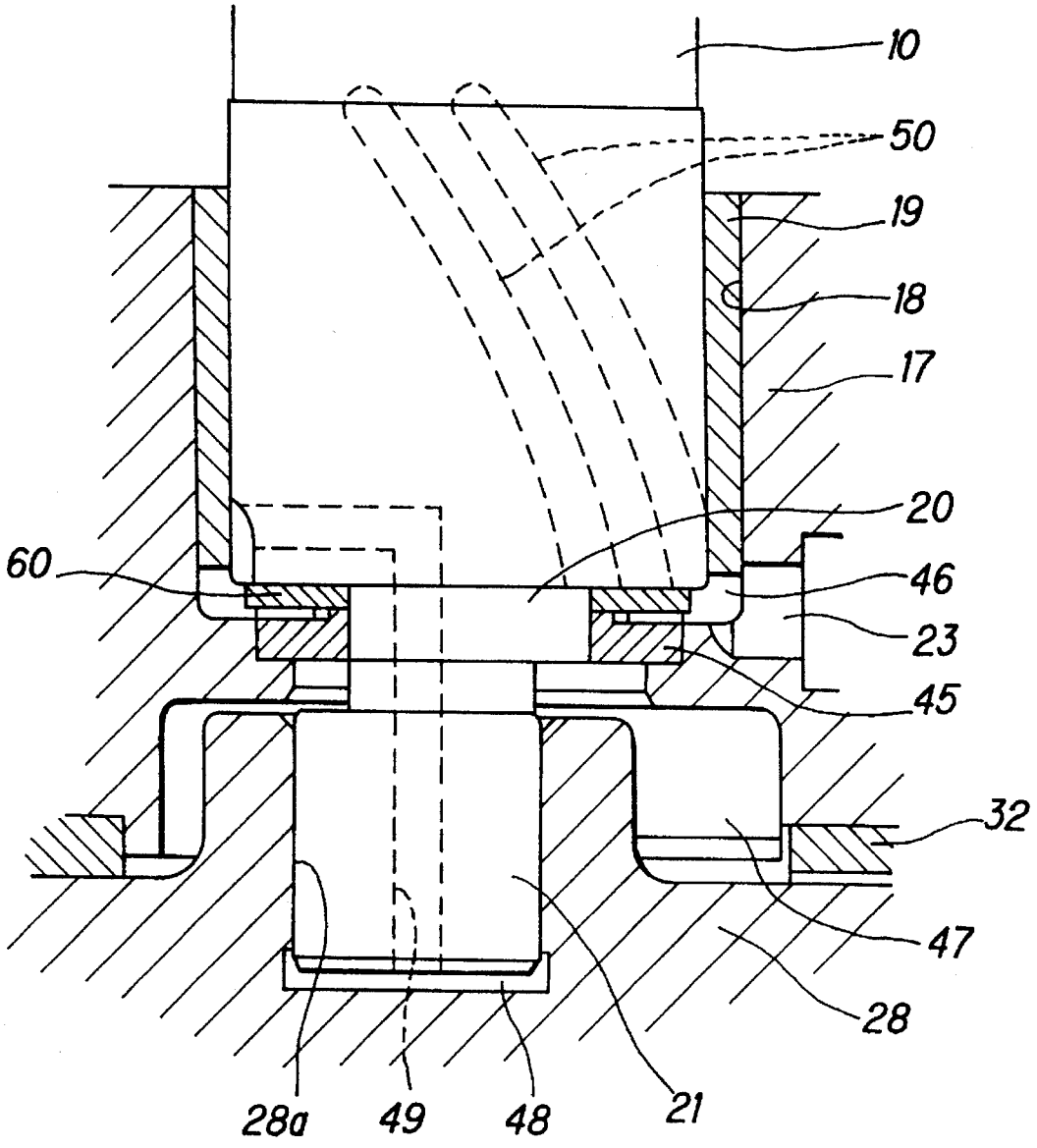
FIG. 4 is an enlarged partial cross section of a second embodiment.

In addition, as shown in FIGS. 4 and 5, a seal washer 60 formed circularly from a ferrite material and whose two sides are polished to a specific surface roughness may be provided between the drive shaft 10 and the seal bearing 45. This simplifies the work process which, in the prior art, requires that the seal bearing 45 and the portion of the drive shaft 10 where it is in contact with the seal bearing 45, be polished to a specific surface roughness. In the present invention, which includes the seal washer 60, only the seal washer needs to be polished to a specific roughness. At the same time, in order to ensure smooth operation at all times, the seal washer 60 merely has to be replaced.

Figure 6:
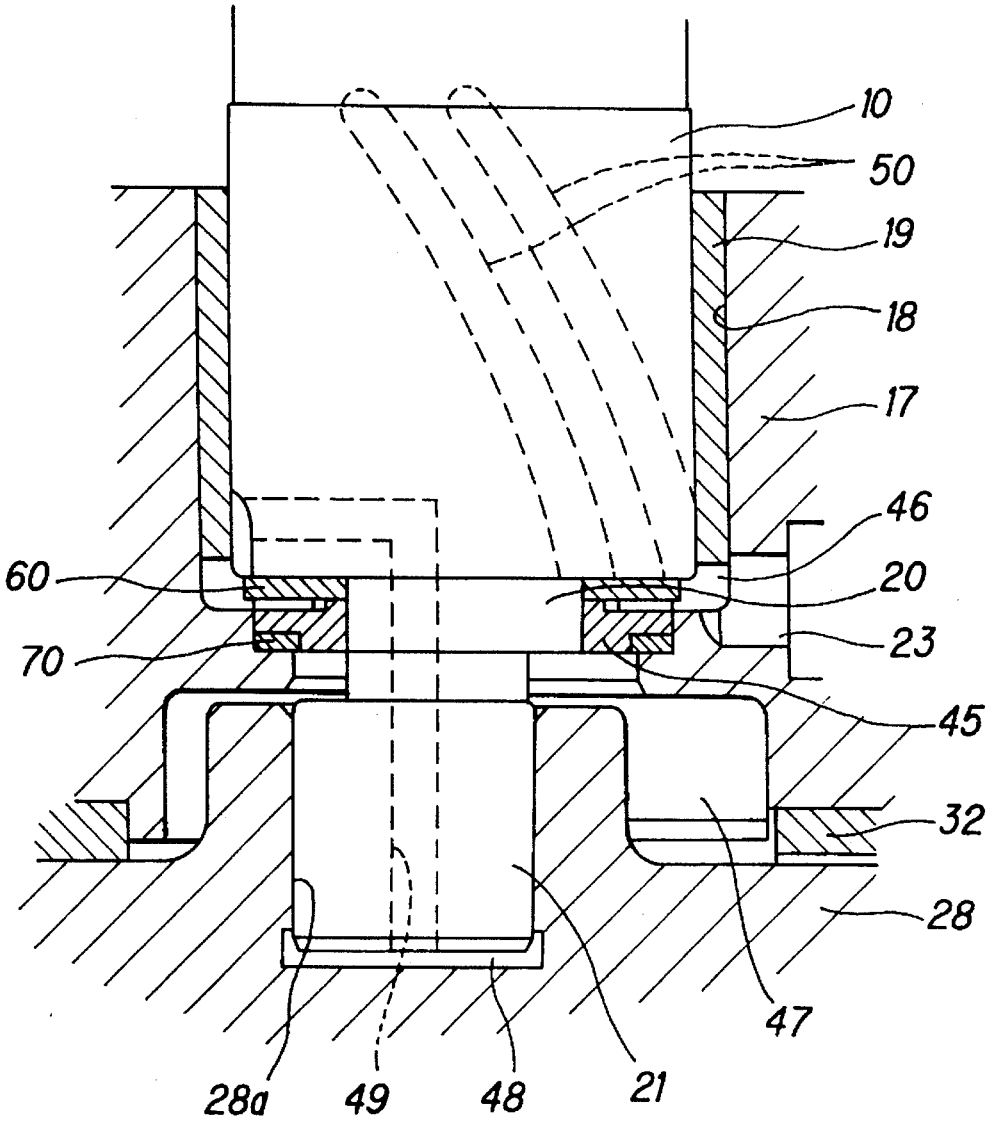
FIG. 6 is an enlarged partial cross section of a third embodiment.
Figure 7:
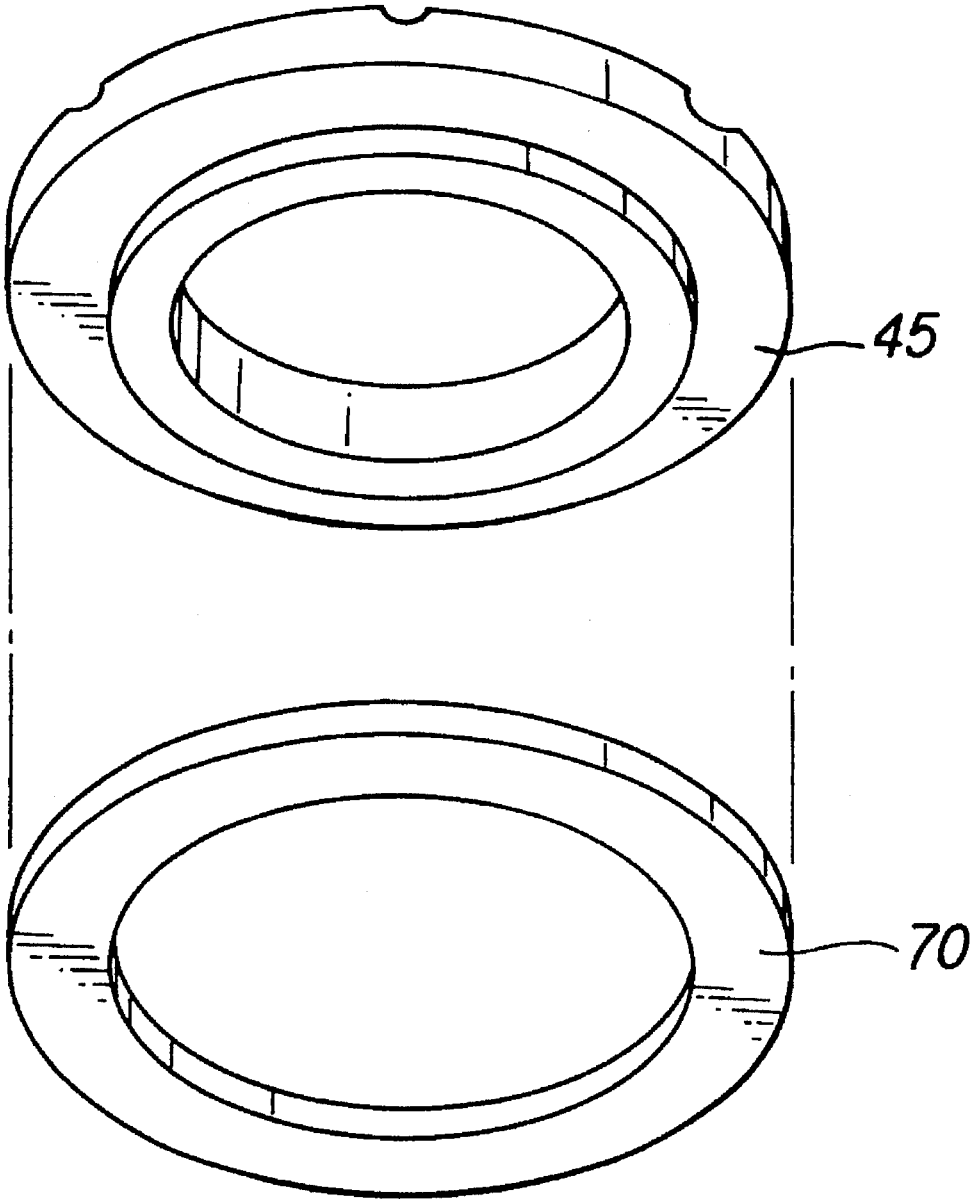
FIG. 7 is a perspective of the seal bearing and the elastic member of the third embodiment.

Furthermore, as shown in FIGS. 6 and 7, a ring-like elastic member 70, which is constituted of rubber or resin, may be provided between the seal bearing 45 and the block 17. With this, the tilting of the drive shaft 10 caused by the force applied to the drive shaft 10 by the orbiting scroll member 28 is absorbed by the elastic member 70. Consequently, the pressure difference between the oil space 46 and the orbiting space 47 is prevented from being reduced due to lubricating oil leaking through a minute gap between the seal bearing 45 and the drive shaft 10 when the drive shaft 10 tilts, which, in turn, maintains the pressure difference between the upstream side and the down stream side of the second oil path, ensuring a sufficient quantity of lubricating oil traveling through the second oil path.

Note that, while in the case presented above, the elastic member 70 prevents any gap forming between the seal bearing 45 and the block 17 by absorbing the tilt of the drive shaft 10, alternatively, the area of contact between the seal bearing 45 and the block 17 may be formed spherically, in correspondence to the tilt of the drive shaft 10 to absorb the tilt of the drive shaft 10 with this spherical surface, thus preventing a gap from forming between the seal bearing 45 and the block 17.

In the embodiments described above, at least one spiral groove which diagonally communicates between the oil space and the upper portion of the main bearing is formed in the surface drive shaft which slides in contact with the main bearing. The spiral groove functions as a pump upon rotation of the drive shaft and constitutes the first oil path, which extends from the oil space through the main bearing to the oil reservoir. At the same time, a second oil path is formed which extends through the oil space, the oil induction hole, the bearing space, the oscillating bearing, the oscillation space and the scroll chamber due to the pressure difference generated by cutting off the oil space from the oscillation space with the seal bearing. Consequently, the main bearing side and the side where the oscillating bearing and the thrust bearing are provided, are lubricated separately, thereby improving the efficiency with which lubrication is performed.

Furthermore, by providing a seal washer with a specific surface roughness between the seal bearing and the drive shaft, the number of processes required when forming the drive shaft and seal bearing is reduced. Also, by providing an elastic member between the seal bearing and the block, a minute gap is prevented from forming in the seal bearing area due to the tilting of the drive shaft caused by the force applied by the oscillating scroll member, to achieve a stable supply of lubricating oil.

While lubrication is much improved in a scroll type compressor structured as described above, a structure according to the present invention that further improves the seal between the oil space and the oscillation space is described below.

Figure 8:
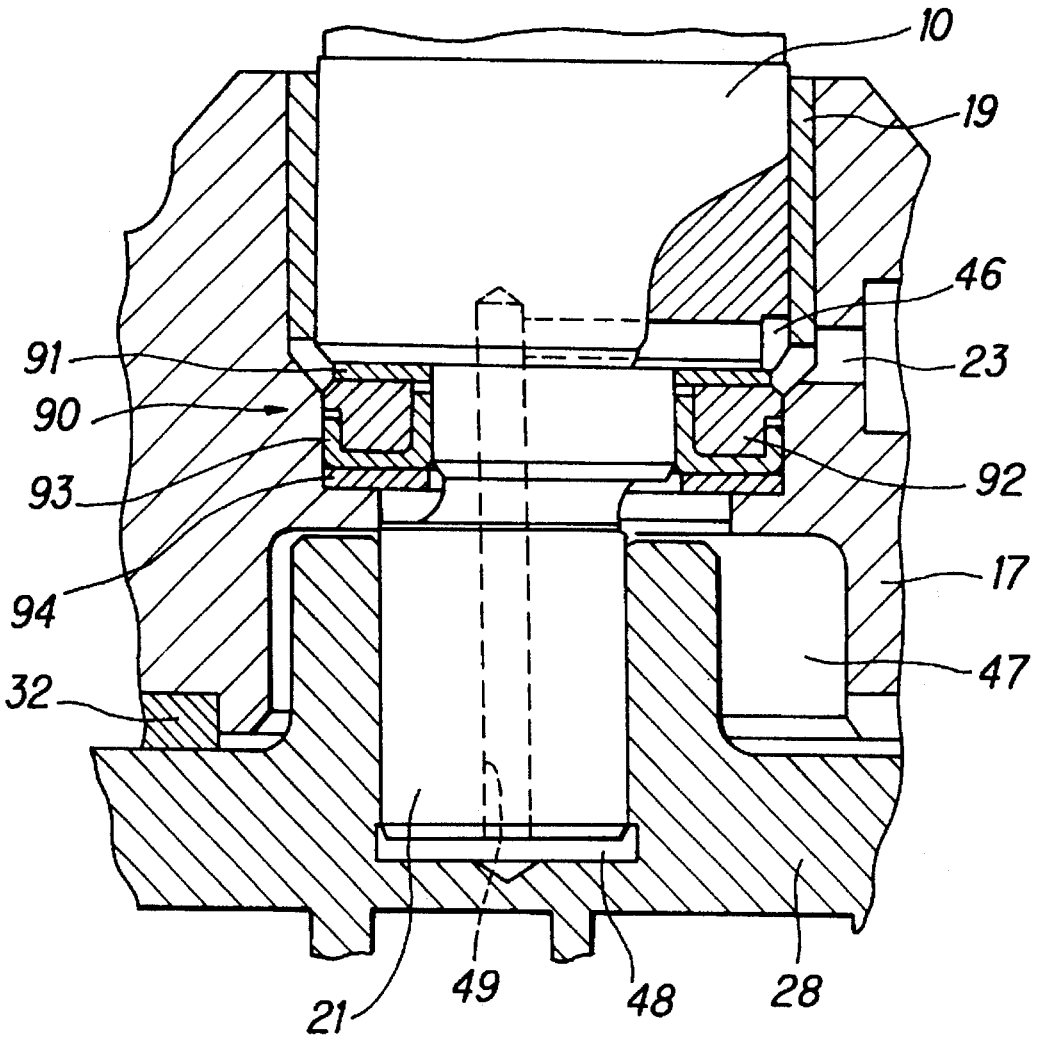
FIG. 8 is an enlarged partial cross section of a fourth embodiment according to the present invention.
Figure 9:
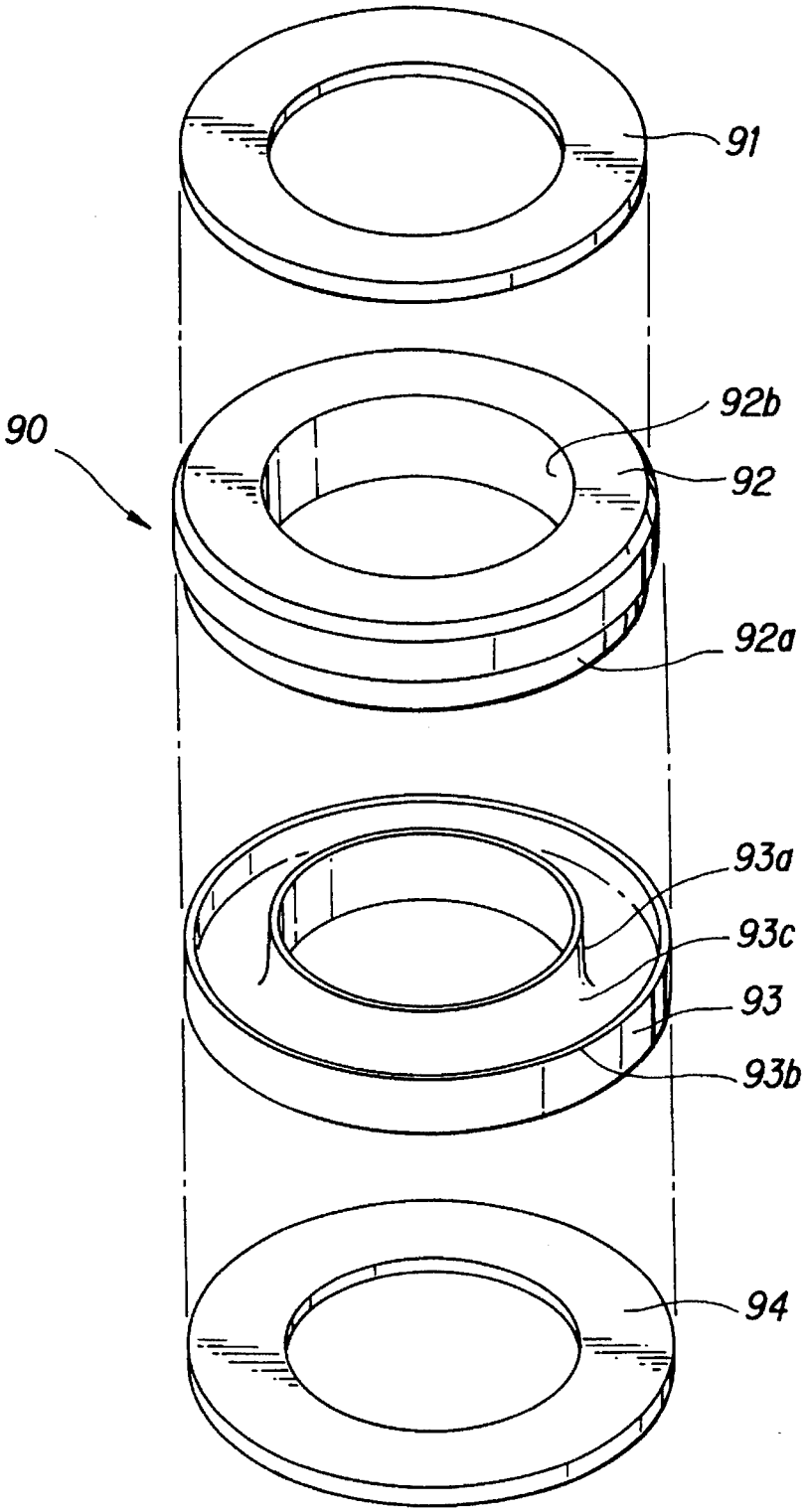
FIG. 9 is an exploded perspective showing the structure of the seal bearing portion of the fourth embodiment.

As shown in FIGS. 8 and 9, a seal bearing portion 90 for cutting off the oil space 46 from the oscillation space 47 may be constituted of a seal washer 91, a seal bearing 92, a seal member 93 and seal reinforcing material 94. The seal washer 91 is similar to the seal washer 60, and is formed circularly of a ferrite material with two side surfaces 91*a* and 91*b* polished to a specific surface roughness. Also, the seal bearing 92, as in the case of the seal bearing 45 described earlier, is formed of a bearing material such as copper, Al, FC, FCD or ferrite, and is provided with a through hole 92*b* at the center of the seal bearing 92 and a fitting projection 92*a*, with which the seal member 93 is fitted.

In addition, the seal member 93 is constituted of a synthetic resin such as teflon, teflon+carbon, teflon+copper or the like. The seal member 93 includes an inner seal portion 93*a* provided between the internal circumferential surface of the through hole 92*b* and the drive shaft 10 to seal the gap therebetween. An outer seal portion 93*b* is provided to seal the gap between the external circumferential surface of the fitting projection 92*a* and the block 17. A side plate 93*c* links the inner seal portion 93*a* and the outer seal portion 93*b* contiguously at one side of the seal bearing 92, so that the cross section of the seal member 93 makes an approximate U-shape.

Note that in this embodiment, the height of the outer seal portion 93*b* is smaller than that of the inner seal portion 93*a* and that the external circumferential surface 92*c* of the seal bearing 92 is in direct contact with the block 17. This ensures that any force applied in the direction of the radius of the seal bearing 92 due to a misalignment of the drive shaft 10 and the like is taken directly by the block 17.

Moreover, the seal reinforcing material 94, which is constituted of a ferrite material, is provided between the seal member 93 and the block 17. This seal reinforcing material 94 prevents the end of the block 17 from coming into direct contact with the side plate 93*c* of the seal member 93 so that the service life of the seal member 93 is increased. Note that while in this embodiment, the seal washer 91, the seal bearing 92, the seal member 93 and the seal reinforcing member 94 are provided in that order from the oil space side, they may be provided in the reverse order, that is, the seal washer 91, the seal bearing 92, the seal member 93 and the seal reinforcing member 94 from the oscillation space side.

By forming the seal bearing portion 90 as described above, the force applied to the drive shaft 10 is reliably absorbed by the seal bearing portion 90 and, at the same time, the oil space 46 is securely cut off from the oscillation space 47. As a result, the back pressure of the oscillating scroll member 28 is maintained at a low or medium level, making it possible to reduce the frictional resistance between the oscillating scroll member 28 and the fixed scroll member 35.

By constituting the seal member with the inner seal portion provided between the internal circumferential surface of the seal bearing and the external circumferential surface of the drive shaft, the outer seal portion provided between the external circumferential surface of the seal bearing and the internal circumferential surface of the block and the side plate, which links the inner seal portion and the outer seal portion contiguously at its two ends, the gaps in the area where the drive shaft and the seal bearing are in contact and also where the seal bearing and the block are in contact are reliably sealed. Also, by providing the seal reinforcing member between the side plate of the seal member and the end of the block, the service life of the seal member is lengthened.

This solves the problems which occur when the orbiting scroll member and the fixed scroll member of a scroll type compressor are formed with aluminum material, achieving reduction in the weight of the compressor, an improvement in machining efficiency and a reduction in production costs.

What is claimed is:

1. A scroll type compressor comprising:

a sealed case having a high pressure space;

a block having a through hole and being secured in said sealed case;

a main bearing positioned in said through hole of said block;

a drive unit mounted in said sealed case and having a rotary drive shaft which is rotatably mounted in said main bearing;

an orbiting shaft connected to and extending eccentrically from a lower end of said drive shaft;

an orbiting scroll member having an orbiting bearing in which said orbiting shaft is inserted, said orbiting bearing and said orbiting shaft defining a bearing space, and a lower surface of said block and said orbiting scroll member defining an orbiting space;

a fixed scroll member secured to said block and being operably engaged with said orbiting scroll member;

a lubricating oil reservoir defined by an upper portion of said block and an interior surface of said sealed case, said reservoir being located within said high pressure space;

an oil space defined between said block and a lower end of said main bearing and being in communication with said lubricating oil reservoir;

at least one spiral groove formed in an external surface of said drive shaft at an axial location thereof corresponding to said main bearing, and having a first end and a second end, wherein said first end is in fluid communication with said oil space and said second end is in communication with said high pressure space;

an oil induction hole fluidically communicating between said oil space and said bearing space; and a seal bearing unit, mounted between said lower end of said drive shaft and said block, isolating said oil space from said orbiting space, wherein said seal bearing unit includes:

a seal bearing, a circular seal washer positioned between said seal bearing and said lower end of said drive shaft, and a seal member positioned between said seal bearing and said block.

2. The scroll type compressor as claimed in claim 1, wherein said lower end of said drive shaft includes a lower axial end face, and said seal bearing unit is mounted between said lower axial end face and said block.

3. The scroll type compressor as claimed in claim 1, wherein said seal bearing unit is constituted by providing, in a direction away from said oil space, in order, said seal washer, said seal bearing, and said seal member.

4. The scroll type compressor as claimed in claim 1, wherein said seal member comprises an inner seal portion engaging an internal circumferential surface of said seal bearing, an outer seal portion engaging an external circumferential surface of said seal bearing, and a side plate connecting said inner seal portion and said outer seal portion.

5. The scroll type compressor as claimed in claim 4, wherein said outer seal portion has an axial dimension which is smaller than a corresponding axial dimension of said inner seal portion so that a portion of said external circumferential surface of said seal bearing is in direct contact with said block.

6. The scroll type compressor as claimed in claim 4, wherein said seal member is constituted of a synthetic resin.

7. The scroll type compressor as claimed in claim 5, wherein said seal member is constituted of a synthetic resin.

8. The scroll type compressor as claimed in claim 1, wherein said seal bearing unit further includes a seal reinforcing member positioned between said circular seal washer and said block.

9. The scroll type compressor as claimed in claim 8, wherein said seal reinforcing member is constituted of a bearing material.

10. The scroll type compressor as claimed in claim 8, wherein said seal bearing portion is constituted by providing, in a direction away from said oil space, in order, said seal washer, said seal bearing, and said seal member.

11. The scroll type compressor as claimed in claim 8, wherein said seal member comprises an inner seal portion engaging an internal circumferential surface of said seal bearing, an outer seal portion engaging an external circumferential surface of said seal bearing, and a side plate connecting said inner seal portion and said outer seal portion.

12. The scroll type compressor as claimed in claim 11, wherein said seal reinforcing member is constituted of a bearing material.

13. The scroll type compressor as claimed in claim 11, wherein said outer seal portion has an axial dimension which is smaller than a corresponding axial dimension of said inner seal portion so that a portion of said external circumferential surface of said seal bearing is in direct contact with said block.

14. The scroll type compressor as claimed in claim 13, wherein said seal member is constituted of a synthetic resin.

15. The scroll type compressor as claimed in claim 11, wherein said seal member is constituted of a synthetic resin.

16. The scroll type compressor as claimed in claim 15, wherein said seal reinforcing member is constituted of a bearing material.

17. An air conditioning system including a scroll type compressor, said scroll type compressor comprising:

a sealed case having a high pressure space;

a block having a through hole and being secured in said sealed case;

a main bearing positioned in said through hole of said block;

a drive unit mounted in said sealed case and having a rotary drive shaft which is rotatably mounted in said main bearing;

an orbiting shaft connected to and extending eccentrically from a lower end of said drive shaft;

an orbiting scroll member having an orbiting bearing in which said orbiting shaft is inserted, said orbiting bearing and said orbiting shaft defining a bearing space, and a lower surface of said block and said orbiting scroll member defining an orbiting space;

a fixed scroll member secured to said block and being operably engaged with said orbiting scroll member;

a lubricating oil reservoir defined by an upper portion of said block and an interior surface of said sealed case, said reservoir being located within said high pressure space;

an oil space defined between said block and a lower end of said main bearing and being in communication with said lubricating oil reservoir;

at least one spiral groove formed in an external surface of said drive shaft at an axial location thereof corresponding to said main bearing, and having a first end and a second end, wherein said first end is in fluid communication with said oil space and said second end is in communication with said high pressure space;

an oil induction hole fluidically communicating between said oil space and said bearing space; and a seal bearing unit, mounted between said lower end of said drive shaft and said block, isolating said oil space from said orbiting space, wherein said seal bearing unit includes:

a seal bearing, a circular seal washer positioned between said seal bearing and said lower end of said drive shaft, and a seal member positioned between said seal bearing and said block.

18. An air conditioning system for an automobile including a scroll type compressor, said scroll type compressor comprising:

a sealed case having a high pressure space;

a block having a through hole and being secured in said sealed case;

a main bearing positioned in said through hole of said block;

a drive unit mounted in said sealed case and having a rotary drive shaft which is rotatably mounted in said main bearing;

an orbiting shaft connected to and extending eccentrically from a lower end of said drive shaft;

an orbiting scroll member having an orbiting bearing in which said orbiting shaft is inserted, said orbiting bearing and said orbiting shaft defining a bearing space, and a lower surface of said block and said orbiting scroll member defining an orbiting space;

a fixed scroll member secured to said block and being operably engaged with said orbiting scroll member;

a lubricating oil reservoir defined by an upper portion of said block and an interior surface of said sealed case, said reservoir being located within said high pressure space;

an oil space defined between said block and a lower end of said main bearing and being in communication with said lubricating oil reservoir;

at least one spiral groove formed in an external surface of said drive shaft at an axial location thereof corresponding to said main bearing, and having a first end and a second end, wherein said first end is in fluid communication with said oil space and said second end is in communication with said high pressure space;

an oil induction hole fluidically communicating between said oil space and said bearing space; and a seal bearing unit, mounted between said lower end of said drive shaft and said block, isolating said oil space from said orbiting space, wherein said seal bearing unit includes:

a seal bearing, a circular seal washer positioned between said seal bearing and said lower end of said drive shaft, and a seal member positioned between said seal bearing and said block.

* * * * *